US008016286B2

(12) United States Patent
Keilhau

(10) Patent No.: US 8,016,286 B2
(45) Date of Patent: Sep. 13, 2011

(54) METHOD AND APPARATUS FOR DRIVING A FAN WHEEL

(75) Inventor: Theo Keilhau, Neusaess (DE)

(73) Assignee: manroland AG, Offenbach/Main (DE)

( * ) Notice: Subject to any disclaimer, the term of this patent is extended or adjusted under 35 U.S.C. 154(b) by 198 days.

(21) Appl. No.: 12/167,117

(22) Filed: Jul. 2, 2008

(65) Prior Publication Data

US 2009/0008873 A1 Jan. 8, 2009

(30) Foreign Application Priority Data

Jul. 3, 2007 (DE) ..... 10 2007 030 907

(51) Int. Cl.
*B65H 29/00* (2006.01)

(52) U.S. Cl. ..... 271/187; 271/315

(58) Field of Classification Search ..... 271/187, 271/315

See application file for complete search history.

(56) References Cited

U.S. PATENT DOCUMENTS

| | | | | |
|---|---|---|---|---|
| 4,790,526 | A * | 12/1988 | Egashira | 271/315 |
| 5,730,056 | A * | 3/1998 | Schmitt | 101/232 |
| 6,341,775 | B1 * | 1/2002 | Matz, IV | 271/186 |

FOREIGN PATENT DOCUMENTS

| | | | |
|---|---|---|---|
| DE | 199 31 744 | C1 | 2/2001 |
| DE | 10 2004 029 170 | A1 | 1/2006 |
| EP | 0 301 205 | B1 | 2/1989 |
| EP | 1 591 394 | A1 | 11/2005 |
| JP | 61-127557 | | 6/1986 |
| WO | WO 02/44065 | A1 | 6/2002 |

OTHER PUBLICATIONS

German Search Report w/English translation of Explanation for Section C.

* cited by examiner

*Primary Examiner* — Michael C McCullough
(74) *Attorney, Agent, or Firm* — Crowell & Moring LLP

(57) ABSTRACT

A method and an apparatus for driving a fan wheel of a web-fed printing press is disclosed. The fan wheel is driven, at least in a predetermined time period ($t_v$-$t_D$) in the production cycle, at a fan wheel speed, which in addition to a rotary drive speed component is comprised of an oscillating speed component.

18 Claims, 2 Drawing Sheets

METHOD AND APPARATUS FOR DRIVING A FAN WHEEL

This application claims the priority of German Patent Document No. 10 2007 030 907.6, filed Jul. 3, 2007, the disclosure of which is expressly incorporated by reference herein.

BACKGROUND AND SUMMARY OF THE INVENTION

The present invention relates to a method for driving a fan wheel of a web-fed printing press, as well as a drive device for the fan wheel, and a delivery module for it.

With known web-fed printing presses, the printed printing substrate, normally a paper web, is conveyed to a folding unit and separated there into individual copies, whereby the individual copies can be collected by means of collect cylinders, etc., to printing products of almost any number of pages. Then the printing products with the desired folding are conveyed to a fan wheel, by means of which they are delivered to a belt delivery. To do so, the fan wheel has externally projecting blades, which, in their progression from the inside to the outside, are curved away from the rotational direction of the fan wheel, wherein a chamber or pocket in which the product is accommodated is formed respectively between a leading and a trailing blade. In the process, the products are slowed down to the fan wheel speed and then, with the aid of a brush-out belt for example, deposited on the belt delivery in an orderly manner in so-called shingle delivery.

However, it has emerged that thick and/or rigid products as well as electrostatically charged products tend not to slide all the way into the base of the fan wheel chamber after exiting the conveyor belt to the fan wheel. This is because electrostatically charged products get "stuck" to the surface of the blades before reaching the target position and thick and/or rigid products do not conform to the curvature of the blades of the fan wheel, but tend to get wedged between a blade and the next subsequent blade. In both cases, the product does not reach the chamber base between the blade and subsequent blade and projects beyond the outer circle of the fan wheel, with the consequence that the subsequent product nudges against the leading product and does not slide into the chamber, which leads to jam-ups, or, if the products do reach the belt delivery, to diminished delivery quality in any case.

A delivery module with this type of fan wheel, an individual drive of the fan wheel, as well as a corresponding belt delivery is disclosed in German Patent Document No. DE 10 2004 029 170 A1, for example. This already discloses a delivery module, which can be adjusted in terms of its horizontal, vertical as well as its angular position with respect to the folding unit. The position of the fan wheel can be adjusted therewith in such a way that the products are transferred with positional accuracy to the blades of the fan wheel irrespective of product width, strength and thickness, thereby achieving an improved delivery quality, but not eliminating the principle problem cited in the foregoing.

Starting herefrom, the subject of the present invention is creating a method for driving a fan wheel of a web-fed printing press as well as a drive device suitable for it and a suitable delivery module, with which the delivery quality can be further improved and jams in the press can be avoided.

According to the invention, it is provided that the fan wheel be driven, at least in a predetermined time period in the production cycle, in a vibrating manner, i.e., with an oscillating fan wheel speed. The drive device according to the invention is therefore correspondingly embodied to drive the fan wheel with the oscillating fan wheel speed, preferably in the predetermined time period in the production cycle, in particular during power-up of the printing press. In addition, the delivery module is embodied according to the invention in such a way that the fan wheel is driven with the oscillating fan wheel speed, preferably in the predetermined time period in the production cycle, in particular during power-up of the printing press.

The fan wheel is induced to vibrate in this manner. As a consequence of the vibrations, no static friction occurs between the blade and the printing product so that the product does not get "stuck" halfway. In fact, a proper conveyance behavior in the direction of the fan wheel base takes effect. The printing product is "shaken" into the fan wheel chamber up to the target position. As a whole, the production reliability of the web-fed printing press is greatly improved with the correspondingly driven fan wheel.

The predetermined time period in the production cycle can extend over the entire production duration. However, it advantageously extends only over phases in which the fan wheel is operated below a specific critical rotational speed, especially when powering up but also when shutting down the printing press. This is because it has emerged that starting at a specific rotational speed, which depends, in-turn, on parameters such as the work cycle of the printing press, the structure of the fan wheel and the quality of the printing product, an adequate inherent momentum of the printing product is present so that, even without the oscillating drive of the fan wheel, it reaches the chamber base or penetrates far enough into the chamber to ensure good delivery quality.

During start-up of the printing press, an oscillating speed component can thus be applied to a rotational speed of the fan wheel, which increases for example according to a target value ramp predetermined by the controller or regulating unit of the fan wheel drive, until the critical rotational speed is achieved, from which point on the inherent momentum of the printing products suffices. In this case, the target value can be used as the critical rotational speed or an actual value measurement can be performed, whereby a fixed value from which point on the inherent momentum of the printing products suffices in any case can be specified as the critical rotational speed, or, if a corresponding adjustment possibility is provided, adjustments can be made product-specifically in terms of the parameters of the product in the respectively manufactured lot.

In this case, it is conceivable, on the one hand, to allow the fan wheel rotational speed to oscillate or to superimpose an oscillating rotational speed component on the predetermined target rotational speed so that the fan wheel oscillates or vibrates in the circumferential direction. This is frequently relatively easy to implement in terms of the structural effort in the case of conventional fan wheels or delivery modules since an individual drive is provided here for the fan wheel in most cases. The individual drive can then be triggered with a target rotational speed, which has an oscillating component. Alternatively or as a supplement thereto, it would also be possible, on the other hand, to set the fan wheel into oscillation in the axial or radial direction.

Especially in the former case, the drive device can advantageously have a rotary drive, which supplies the oscillating rotational speed to the fan wheel, for example, an electric motor 25*a* and/or a current converter 25*b*. An oscillation, e.g., in the form of an oscillating input voltage, can then be superimposed on the normal operating curve of the drive regulation (rotational speed as a function of time) of the electric motor and/or current converter. Thus, a fine adjustment of the rotational speed oscillation with respect to the changing oscillation amplitude or oscillation frequency can be made as a function of the momentary rotational speed, if this should be necessary.

In the second case, a horizontally or vertically, or axially or radially displaceable support of the fan wheel can be provided, as well as a corresponding linear drive, with which the fan wheel can also driven in an oscillating manner in the radial or axial direction in addition to the rotational movement. This is advantageous in particular in the case of such a delivery module, which, as in Document DE 10 2004 029 170 A1 that was already mentioned at the outset, already has a horizontally displaceable substructure.

Alternatively or as a supplement, the fan wheel could also be attached in a swiveling manner to an axially parallel suspension and an oscillating swivel movement could be superimposed on the rotational movement of the fan wheel.

Finally, it would also be conceivable to rotationally drive the fan wheel free of oscillations and merely set the blades into oscillation.

Advantageous developments are explained in greater detail along with additional preferred developments of the invention in the following on the basis of the enclosed drawings. The invention is not limited hereto, however. In fact, the features of the claims and the embodiment described in the following can be combined in any combination without departing from the scope of the invention.

DETAILED DESCRIPTION OF THE DRAWINGS

Figure 1:
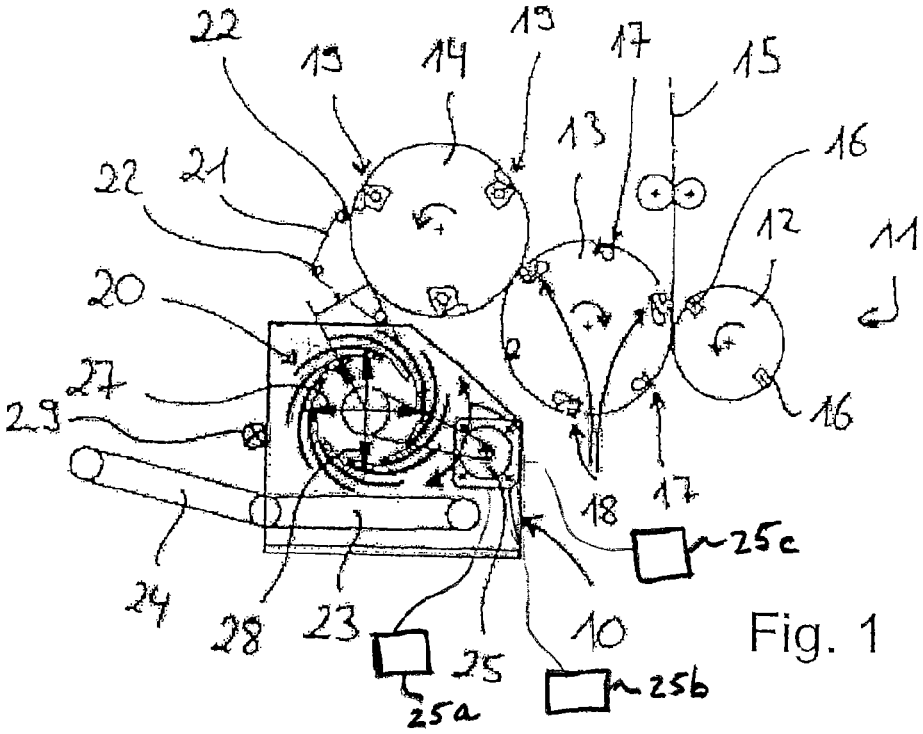
FIG. 1 is a side view of an inventive delivery module according to a first embodiment of the invention together with a folding unit of a printing press.

FIG. 1 shows an inventive delivery module 10 together with a folding unit 11 of a web-fed printing press. The folding unit 11 has a cutting knife cylinder 12, a tucker blade cylinder 13 as well as a folding jaw cylinder 14. The cutting knife cylinder 12 and the folding jaw cylinder 14 rotate in the same direction as well as in opposite directions of the tucker blade cylinder 13. A printing substrate 15 is moved or fed between the cutting knife cylinder 12, tucker blade cylinder 13 and folding jaw cylinder 14. The cutting knife cylinder 12 is comprised of two cutting knives 16. Copies can be separated from the printing substrate 15 by means of the cutting knives 16. The tucker blade cylinder 13 is comprised of three tucker blades 17 as well as three pin devices 18. The three tucker blades 17 are positioned respectively on the circumference of the tucker blade cylinder 13 spaced apart from one another at an angle of 120°. The three pin devices 18 are also positioned respectively on the circumference of the tucker blade cylinder 13 spaced apart from one another at an angle of 120°, whereby a pin device 18 is arranged respectively between two tucker blades 17. The folding jaw cylinder 14 preferably has three folding jaws 19, which are positioned on the circumference of the folding jaw cylinder 14 spaced apart from one another also at an angle of 120°.

In order to provide a fold on a copy separated from the printing substrate 15 by means of the cutting knife cylinder 12, the cutting knife cylinder 12, tucker blade cylinder 13 as well as the folding jaw cylinder 14 cooperate with one another in such a way that, when separating a copy from the printing substrate 15 with the aid of a cutting knife 16 of the cutting knife cylinder 12, the separated copy is held at the beginning of the sheet by a pin device 18 and moved forward with the rotation of the tucker blade cylinder 13. This moves the separated copy into a relative position between the tucker blade cylinder 13 and folding jaw cylinder 14 that is defined for fold formation, wherein when this relative position is reached, a tucker blade 17 of the tucker blade cylinder 13 presses the copy into the folding area between the opened folding jaws 19 of the folding jaw cylinder 14, whereas the pin device 18 releases the copy. The copy held in this way by the folding jaw cylinder 14 is then moved forward with the rotation of the folding jaw cylinder 14 and at a suitable position transferred by the folding jaw cylinder 14 to the inventive delivery module 10.

Figure 2:
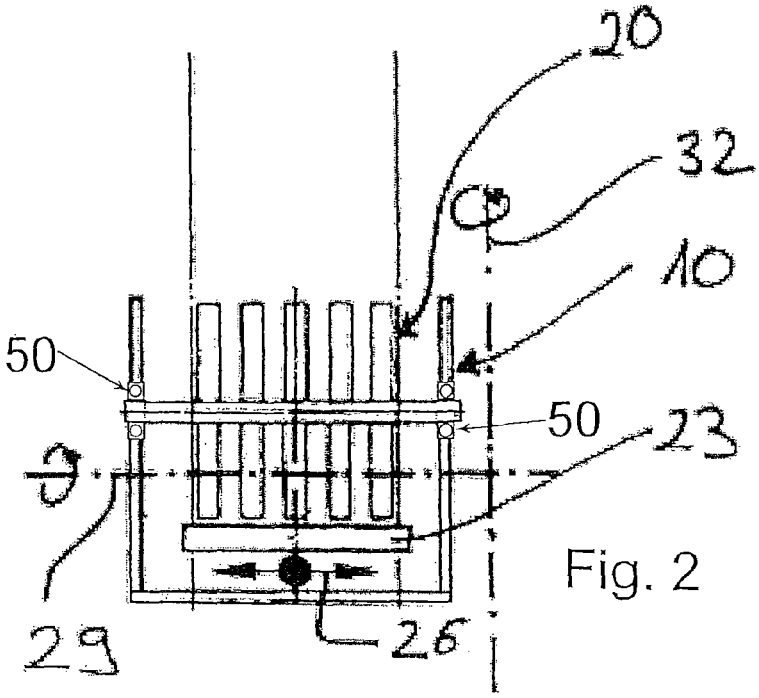
FIG. 2 is a front view of the delivery module depicted in FIG. 1.

According to FIGS. 1 and 2, the delivery module 10 has a fan wheel 20 supported on support 50 with several blades, wherein adjacent blades of the fan wheel 20 delimit blade pockets. As already mentioned above, copies or products held in the folding jaw cylinder 14 are transferred by the folding jaw cylinder 14 to the delivery module 10, wherein to do so conveyor belts 21 are used, which are directed on guide rollers 22. The folded copies or products are released accordingly in the area of the conveyor belts 21 by the folding jaw 19 of the folding jaw cylinder 14, transferred to the conveyor belts 21 and introduced via the conveyer belts 21 into the blade pockets of the fan wheel 20.

Along with the fan wheel 20, the delivery module 10 is also comprised of a delivery belt 23, wherein the fan wheel 20 deposits the folded copies or products on the delivery belt 23. A further transport belt 24 can be connected to the delivery belt 23. As FIG. 1 shows, the fan wheel 20 is assigned an individual drive 25, which drives the fan wheel 20 and the delivery belt 23 as the case may be. In the depicted exemplary embodiment, the inventive delivery module 10 is comprised accordingly of the fan wheel 20, the individual drive 25 assigned to the fan wheel 20 and the delivery belt 23.

In the depicted example, the application of the oscillating fan wheel speed component does not occur, however, via the individual drive 25, as will be explained in further detail below. If this is desired, the delivery belt 23 can be assigned its own drive, however, and the individual drive of the fan wheel can be arranged directly on the fan wheel shaft.

In the present exemplary embodiment, the oscillating speed component, on the other hand, is supposed to occur via an arrangement of the fan wheel 20 that is displaceable and drivable in the horizontal and/or vertical direction relative to the folding unit 11, in the depicted example via an arrangement that is linearly movable in the horizontal direction in terms of the double arrow 26 in FIG. 2.

For this purpose, the fan wheel 20 along with its individual drive 25 can be supported via its framework on a frame (not shown) of the delivery module so that it is linearly displaceable and drivable, as can be seen best in FIG. 2, wherein then the oscillation in the horizontal direction, which will still be discussed in more detail in connection with FIG. 3 (and at the same time represents the axial direction of the fan wheel), is generated via a corresponding linear motor and can be transmitted to the fan wheel 20 relative to the frame (not shown). In order to ensure that displacement and oscillation are simple, the fan wheel 20 can also be displaceably mounted or guided in the horizontal and/vertical direction in a rail system (not shown), wherein the actual, oscillating linear movement can preferably be accomplished via electromotive, but also via pneumatic or hydraulic drive devices.

Additionally or alternatively, the inventive delivery module 10 can be embodied so it can be displaced and oscillated in a further horizontal direction as well as in the vertical direction relative to the folding jaw cylinder 14 in terms of the double arrows 27 and 28 shown in FIG. 1, wherein in this case, the fan wheel 20 along with the individual drive 25 as well as the delivery belt 23 and the brush-out devices (not shown) can be displaced and oscillated overall in the horizontal and/or vertical direction. As indicated in FIG. 1 and FIG. 2, the inventive delivery module 10 or fan wheel 20 can furthermore be arranged so that they can be driven in a rotating or swiveling and oscillating manner around an axis of rotation 29.

With a delivery module 10 that can be displaced and oscillated in such a manner, it is possible to adapt the same optimally to changing products, in particular to changing product widths as well as to changing product strengths or product thicknesses so that the oscillation can always be coordinated optimally with the respective product, but also with the momentary operating parameters, such as the momentary rotational speed of the fan wheel 20 for example. In other words, a higher or lower oscillation amplitude or frequency for example could be adjusted as a function of the momentary rotational speed.

The oscillation drive of the fan wheel 20 or of the delivery module 10 relative to the folding unit 11 can in this case be connected manually or be fully automated as a function of the momentary point in time in the production cycle or as a function of the momentary rotational speed of the fan wheel stored in the drive controller or drive regulator. It is also possible to store different oscillation amplitudes or frequencies as a function of predefined product widths and/or product thicknesses in a control computer for the delivery module 10 in order to finely tune the oscillation of the fan wheel fully automatically as a function of these presets.

Figure 3:
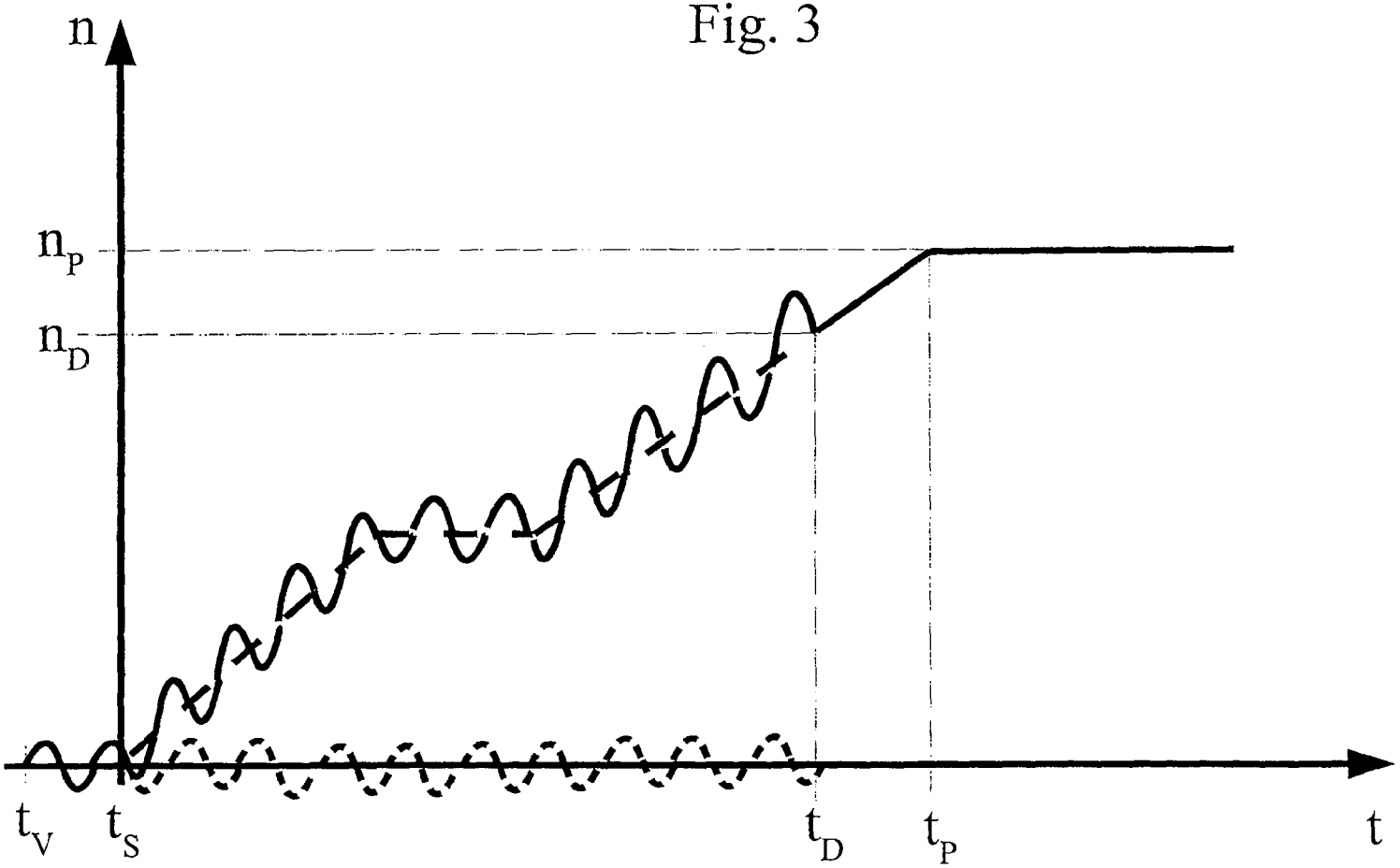
FIG. 3 is an operating curve of a drive device for a fan wheel of a delivery module according to another embodiment of the invention.

FIG. 3 depicts the operating curve stored in a controller 25*c* of the rotary drive of the self-driven fan wheel, which shows the target rotational speed progression over time in the production cycle, for an embodiment of the invention, in which the oscillation of the fan wheel is induced by a rotary motor with an oscillating or vibrating rotational speed component.

One can see that the target rotational speed of the fan wheel during power-up of the printing presses beginning at the starting time $t_s$ of the press increases along a "target ramp" until time $t_p$ when the production rotational speed $n_p$ is reached. In a range of below a critical rotational speed $n_D$ achieved at time $t_D$, from which point on an adequate inherent momentum of the products is assumed, the oscillation component depicted as a finely dashed line is in a manner of speaking modulated or superimposed on the target ramp depicted here as a chunky dashed line, so that, in this rotational speed range, the depicted image of the operating curve that is increasing with a superimposed wave is produced. Furthermore, one sees that the operating curve has a certain progression since the fan wheel is already acted upon with the oscillating target rotational speed starting at time $t_v$ before the starting point of the press.

On the other hand, if, instead of the rotational speed oscillation, the fan wheel is acted upon by an oscillation in the horizontal direction or the axial direction of the fan wheel, as in the example depicted in FIGS. 1 and 2, the target ramp of the rotational speed in the range below $n_D$ runs along the chunky-dashed-line straight sections, whereas the horizontal drive has the target value progression indicated by the finely dashed line.

Of course, deviations from the depicted variation are possible without abandoning the fundamental idea of the invention.

Thus, a rotational-speed-dependent controller is indeed provided for in the example of the controller of the fan wheel self-propulsion shown in FIG. 3. In addition, the invention would be just as conceivable however in the case of a position-controlled self-propulsion of the fan wheel, whereby then the position target value oscillates accordingly. Rotational speed regulation or positional regulation would likewise be conceivable.

In the depicted exemplary embodiment, the oscillation component is furthermore approximately sinusoidal. However, within the scope of the invention, other waveforms would also be conceivable, in particular a rectangular or sawtooth shape.

In the depicted exemplary embodiment, the fan wheel or the delivery module are driven with a forced oscillation. However, it would also be conceivable to introduce a free-running speed component that decays over the desired time period at the beginning of this time period, for example via suitable spring supports or the like.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for driving a fan wheel of a web-fed printing press, comprising the step of driving the fan wheel, at least in a predetermined time period ($t_v$-$t_D$) in a production cycle, at a fan wheel speed, which in addition to a rotary drive speed component is comprised of an oscillating speed component such that the oscillating speed component vibrates the fan wheel.

2. The method according to claim 1, wherein the predetermined time period ($t_v$-$t_D$) in the production cycle is a time period ($t_v$-$t_D$) during which the fan wheel rotates at a rotational speed (n) below a limit rotational speed ($n_D$).

3. The method according to claim 1, wherein the predetermined time period ($t_v$-$t_D$) is a time period ($t_v$-$t_D$) during a start-up of the printing press.

4. The method according to claim 1, wherein the fan wheel vibrates in a circumferential direction.

5. The method according to claim 1, wherein the fan wheel vibrates in at least one of an axial direction and a radial direction.

6. The method according to claim 1, wherein the oscillating speed component has a predetermined oscillation frequency and oscillation amplitude.

7. The method according to claim 6, wherein the predetermined oscillation frequency and oscillation amplitude in the predetermined time period ($t_v$-$t_D$) are at least substantially constant.

8. The method according to claim 6, wherein at least one of the predetermined oscillation frequency and the oscillation amplitude in the predetermined time period fall with an increasing fan wheel rotational speed at least in a rotational speed range adjacent from below to a limit rotational speed.

9. The method according claim 1, wherein a limit rotational speed ($n_D$) is predetermined in such a way that products to be accommodated by the fan wheel feature an adequate momentum in a rotational speed range above the limit rotational speed in order to automatically arrive at a desired position in a respective fan wheel chamber of the fan wheel.

10. A printing press delivery module, comprising:

a drive device coupled to a fan wheel wherein the drive device is controlled by a controller such that the fan wheel is driveable, at least in a predetermined fan wheel rotational speed range (0-$n_D$), at a fan wheel speed, which in addition to a rotary drive speed component has an oscillating speed component such that the oscillating speed component vibrates the fan wheel.

11. The printing press delivery module according to claim 10, wherein the drive device is comprised of a rotary drive device for independently driving a rotary drive of the fan wheel, with which the fan wheel is rotationally driveable at a rotational speed, which in addition to the rotary speed component has the oscillating speed component.

12. The printing press delivery module according to claim 11, wherein the rotary drive device is comprised of an electric motor which converts at least one of an oscillating input voltage and an oscillating input current into the rotational speed with the oscillating rotational speed component.

13. The printing press delivery module according to claim 11, wherein the rotary drive device is comprised of a current converter unit which converts at least one of an oscillating target input voltage and an oscillating target input current into an actual rotational speed of the fan wheel with the oscillating rotational speed component.

14. The printing press delivery module according to claim 10, wherein the controller adjusts a rotational speed or a position of the fan wheel or at least one of an input voltage and an input current of an electric motor or of a current converter in such a way that the fan wheel can be rotationally driven at the rotational speed, which in addition to the rotary speed component has the oscillating speed component.

15. The printing press delivery module according to claim 10, further comprising a support that is displaceable in at least one of a horizontal and a vertical direction, wherein the fan wheel is supported on the support.

16. The printing press delivery module according to claim 10, further comprising a support, wherein the fan wheel is supported on the support, that is swivelable around an axis parallel to an axis of rotation.

17. The printing press delivery module according to claim 10, wherein the fan wheel vibrates in a circumferential direction.

18. The printing press delivery module according to claim 10, wherein the fan wheel vibrates in at least one of an axial direction and a radial direction.

* * * * *